US006250975B1

(12) United States Patent
LaPointe

(10) Patent No.: US 6,250,975 B1
(45) Date of Patent: Jun. 26, 2001

(54) ANTI-ROTATION GROUND TERMINAL FOR WELD NUT

(75) Inventor: Heath Allen LaPointe, Monroe, MI (US)

(73) Assignee: EWD., L.L.C., El Paso, TX (US)

( * ) Notice: Subject to any disclaimer, the term of this patent is extended or adjusted under 35 U.S.C. 154(b) by 0 days.

(21) Appl. No.: 09/727,185

(22) Filed: Nov. 30, 2000

(51) Int. Cl.[7] ..... H01R 11/11
(52) U.S. Cl. ..... 439/883
(58) Field of Search ..... 439/883, 777

(56) References Cited

U.S. PATENT DOCUMENTS 4,679,888 * 7/1987 William ..... 439/883
4,753,615 * 6/1988 Weidler et al. ..... 439/883
4,775,339 * 10/1988 Sasaki et al. ..... 439/883
5,487,685 * 1/1996 Stillkack et al. ..... 439/883
5,842,894 * 12/1998 Melberg ..... 439/883

* cited by examiner

*Primary Examiner*—Brian Sircus
*Assistant Examiner*—Phuong K T Dinh
(74) *Attorney, Agent, or Firm*—Young & Basile, P.C.

(57) ABSTRACT

An eyelet terminal of the type used to connect an electrical wire or cable to a junction box or grounding terminal in an automotive electrical system, comprising an inverted cup-shaped eyelet adapted to be placed over a nut at the terminal and to mate with the nut with a non-rotating fit. The eyelet has a hole in an upper surface thereof to allow passage therethrough of a terminal stud or a bolt by which the eyelet terminal can be permanently secured at the terminal mounting location. The eyelet terminal is especially useful for establishing ground connections to weld nuts.

10 Claims, 3 Drawing Sheets

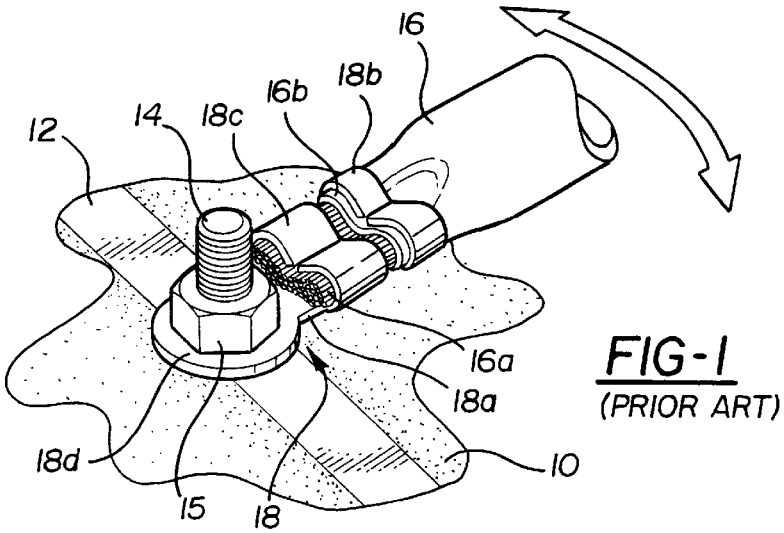
FIG-1
(PRIOR ART)
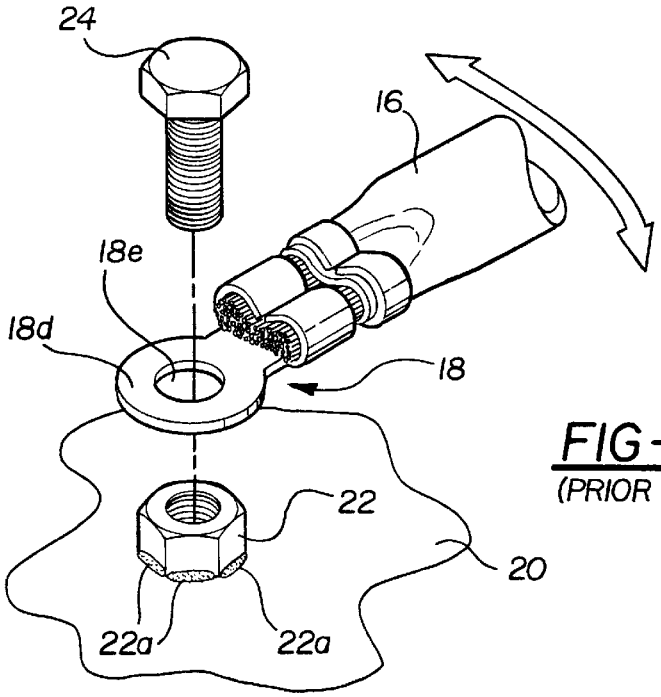
FIG-1A
(PRIOR ART)
FIG-2
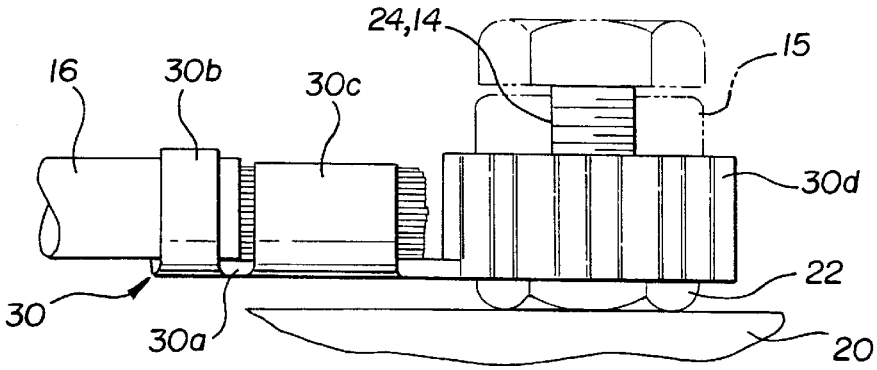

ANTI-ROTATION GROUND TERMINAL FOR WELD NUT

FIELD OF THE INVENTION

The present invention is in the field of eyelet terminals for connecting electrical wires and cables to automotive electrical system terminals.

BACKGROUND OF THE INVENTION

Eyelet terminals are commonly used in automotive electrical systems to connect wires or cables to terminal points such as battery and junction box terminals and grounds. The eyelet terminals are typically formed from relatively heavy gauge metal to accommodate large terminals, to carry high levels of current, and to be securely crimped to heavy duty cables. One end of the eyelet terminal typically has a flat, annular eyelet designed to fit over a threaded post or stud terminal, secured to the stud with a nut.

Eyelet terminals are also used with "weld nut" terminal connections, in which a nut is welded or otherwise fixed in place on a metal grounding surface or over a female terminal hole to receive a bolt or threaded stud for a ground or power connection.

Rotation of the eyelet terminal and the cable to which it is attached is a common problem encountered when tightening an eyelet-securing nut or bolt onto a stud or weld nut. One known method for solving the rotation problem is to extend perpendicular anti-rotation tabs or legs from portions of the eyelet terminal to engage slots in the underlying mounting structure when the eyelet terminal is placed. Subsequent tightening of a nut or bolt to secure the eyelet terminal at the electrical connection point cannot rotate the eyelet.

The usefulness of such anti-rotation structure on the eyelet terminal is limited. The nature of weld nut terminals generally precludes the use of anti-rotation tabs extending from the eyelet terminal. If the weld nut is used as an electrical ground, the nut may be welded on a solid metal surface. In some instances it may also be desirable to establish secondary ground or power connections to existing nut-using connections which do not lend themselves to the use of an additional eyelet terminal having anti-rotation tabs.

SUMMARY OF THE INVENTION

The present invention is an eyelet terminal having an eyelet portion designed to be drop-fit onto an existing terminal nut, preferably over a "weld nut" to ground but not excluding a nut securing an existing power or ground connection. The eyelet portion of the inventive terminal is generally in the form of an inverted metal cup with a nut-engaging internal geometry, for example a polygon with six or preferably twelve sides, adapted to engage corners and flats on the terminal nut to prevent rotation when a bolt or second nut is threaded over the cup terminal to lock it in place. For this purpose, the eyelet cup includes a hole in its upper surface for admitting a bolt or a stud member to which a securing nut can be threaded.

The invention is especially useful as a ground terminal for weld-nut type grounding points, but is readily adaptable to making secondary eyelet terminal connections to already-established terminals secured with a nut. In the latter case, the nut-engaging eyelet cup eliminates the need to remove the underlying terminal nut in order to make a secondary connection. In both cases, the invention uses a terminal nut's own geometry as an anti-rotation feature, rather than relying on features of the underlying mounting structure.

These and other features and advantages of the invention will become apparent upon a further reading of the specification, in light of the accompanying drawings.

BRIEF DESCRIPTION OF THE DRAWINGS

FIG. 1 is a perspective view of a prior art stud-type terminal with a standard eyelet and nut connection on a vehicle junction box.

FIG. 1A is a perspective, exploded view of a prior art weld nut-type ground terminal on a metal grounding surface in a vehicle, using a bolt to secure a standard eyelet terminal to the weld nut.

FIG. 2 is a side elevational view of a weld nut-type terminal connection using eyelet terminal according to the present invention.

DETAILED DESCRIPTION OF THE ILLUSTRATED EMBODIMENT

Figure 2A:
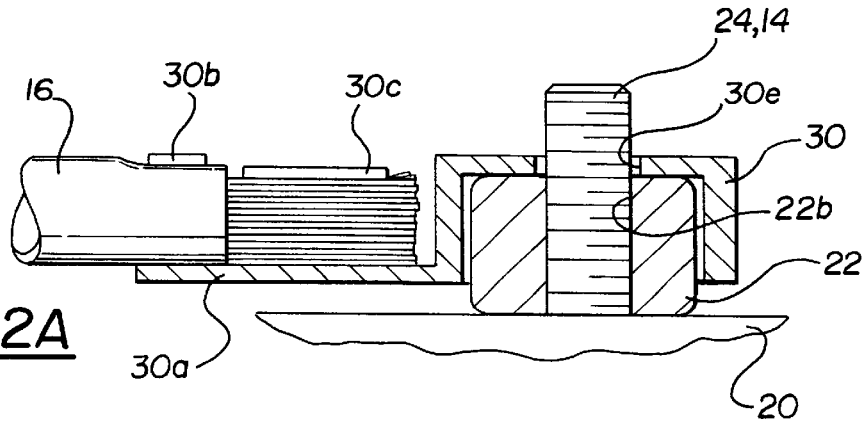
FIG. 2A is a side section view of the terminal connection of FIG. 2.
Figure 3:
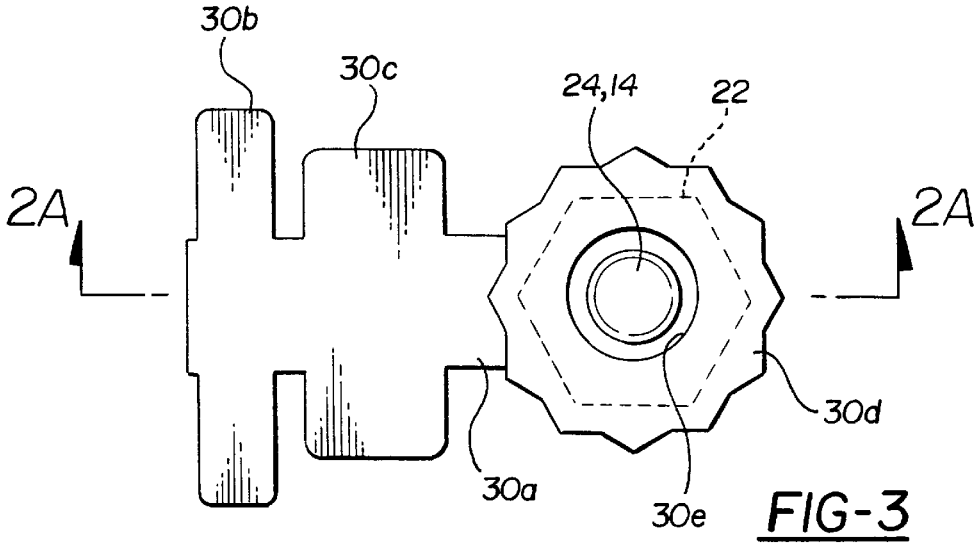
FIG. 3 is a plan view of the weld nut terminal and eyelet according to the present invention.
Figure 3A:
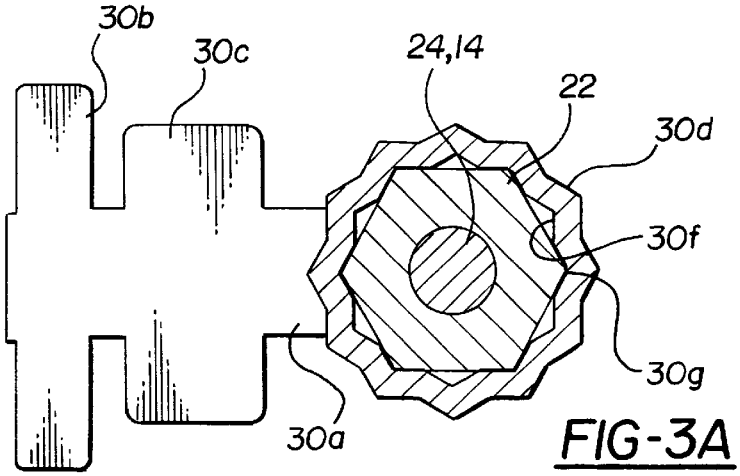
FIG. 3A is a plan, sectional view of the eyelet portion of the terminal and weld nut connection in FIG. 3.

Referring first to FIG. 1, a typical prior art terminal connection is illustrated for an automotive junction box 10. Junction box 10 comprises a plastic housing (only a small portion of which is shown) in which electrical pathways are established by bus bars 12 mounted in various layers and patterns inside the junction box, for example on insulation plates. The structure of junction boxes and their bus bar layouts is well known to those skilled in the art. For the purpose of supplying power to the junction box, a terminal connection point is established with a structure for mounting an electrical cable. In the illustrated embodiment, the connection point is established by a threaded metal stud 14 anchored securely in the junction box and extending up through one of bus bars 12 in known manner. An electrical power cable 16 from a battery or wire harness is electrically connected to bus bar 12 via an eyelet terminal 18 having a flat, annular eyelet portion 18*d* with a hole 18*e* sized to fit over stud 14. As the flat eyelet 18*d* rests on bus bar 12 in electrical connection therewith, a metal nut 15 is threaded over stud 14 and down onto eyelet terminal 18 to securely lock terminal 18 against bus bar 12.

The illustrated eyelet terminal 18 in FIG. 1 is a conventional form, having a wire connecting stem 18*a* with sets of crimped tabs 18*b*, 18*c* sized to be crimped over insulated and exposed portions 16*a*, 16*b* of electrical cable 16, thereby both mechanically and electrically connecting cable 16 to eyelet 18*d* which in turn makes the connection to the junction box terminal.

Referring next to FIG. 1A, an alternate type of terminal connection frequently used in the prior art for an electrical ground is formed by a "weld nut" 22. Illustrated weld nut 22 is a standard metal nut similar to that shown at 15 in FIG. 1, welded to a metal grounding surface or conductor 20 by welds 22*a*. A cable such as 16 can be electrically connected to ground through the weld nut using a standard eyelet terminal 18 with a common bolt 24.

While the weld nut terminal connection of FIG. 1A is illustrated as a ground connection, those skilled in the art will recognize the utility of weld nut-type terminals for power connections as well. Additionally, weld nut 22 need not be welded to a blind metal surface such as 20, but can also be secured in place over a threaded hole through which an electrical connection can be made to an underlying conductor by a bolt or a double-ended stud.

As illustrated by the arrows in FIGS. 1 and 1A, eyelet terminal 18 and its attached cable 16 are subject to rotation upon the tightening of a respective nut 15 or bolt 24 at the terminal connection point. This rotation is undesirable in a vehicle wire harness assembly environment, as it tends to affect the slack tolerances predetermined for a particular run of wire harness cable relative to a plurality of pre-established, clip-in connection points for the wire harness throughout the vehicle. It is also undesirable to have cable 16 misaligned from a desired placement with respect to subsequent assembly operations, in which people may be trying to install various vehicle components in close proximity to the cable; a misaligned cable gets in the way. It will further be apparent that in weld nut-type terminal arrangements as shown in FIG. 1A, eyelet terminal 18 must be held in place with one hand on top of weld nut 22 while bolt 24 is installed over the aligned holes.

FIGS. 2–2A and 3–3A illustrate an inventive eyelet terminal 30 particularly adapted for one-handed, rotation-preventing connection to weld nut-type terminals of the type shown in FIG. 1A, but also useful for any terminal employing a nut, such as that shown in FIG. 1. Inventive eyelet terminal 30 includes a conventional wire connecting stem 30*a* with conventional crimp tabs 30*b*, 30*c*, but eyelet portion 30*d* takes the form of an inverted cup sized and shaped to fit over and engage a standard terminal nut in an anti-rotational manner. Eyelet 30*d* includes a hole 30*e* in its upper surface to let through a bolt or stud, and has an integral side wall extending downwardly and having an internal geometry comprising a polygonal arrangement of flats and points 30*f*, 30*g*, in the illustrated embodiment in the form of a twelve-sided polygon. It will be understood that while this twelve-sided form is preferred for use with typical hexagonal terminal nuts, the interior geometry of the cup can be altered to fit virtually any shape or size terminal nut.

Terminal 30 can be drop-fit on weld nut 22, with its internal flats and points 30*f*, 30*g* naturally mating with the faces of weld nut 22 with a minimum of jiggling or alignment. Once fitted over weld nut 22, terminal 30 cannot rotate with respect to the nut, thereby providing an anti-rotation connection prior to applying a securing nut or bolt.

In the illustrated embodiment of FIGS. 2 and 2A, the depth of the eyelet cup 30*d* is less than the height of weld nut 22 from grounding surface 20, which will generally be preferred in order to keep the terminal out of contact with the grounding surface except through weld nut 22.

Hole 30*e* in the upper surface of eyelet cup 30*d* is equal to or greater in diameter than 20 threaded hole 22*b* in weld nut 22. The cup nature of eyelet 30*d* not only prevents rotation upon initial fitting over the weld nut, but further keeps these two holes 30*e*, 22*b* in alignment until terminal 30 can be more permanently secured to the weld nut, for example with bolt 24.

Although the typical weld nut-type terminal uses a bolt to secure the cable's eyelet terminal, it will be understood by those skilled in the art that the connection between terminal 30 and weld nut 22 may be secured via a threaded stud similar to that shown in FIG. 1, and a second nut threaded down over an upper end of the stud protruding above eyelet cup 30*d*. In some cases there may also be a bore coaxial with and below weld nut 22, possibly threaded, for electrical connection to a conductive pathway below weld nut 22.

It will accordingly be realized by those skilled in the art that terminal 30 lends itself equally well to a power connection where terminal 30 is placed over an existing nut-using terminal connection like that shown in FIG. 1. Terminal 30 could be placed over the stud 14 and nut 15 in FIG. 1 and secured in place with an additional nut threaded down over the top of stud 14 to lock terminal 30 in place. The interaction between the interior geometry of eyelet cup 30*d* and nut 15 will prevent rotation of terminal 30 and its attached cable in the same manner as if applied to the weld nut of FIG. 1A. The adaptability of the inventive eyelet to virtually any nut-using terminal is particularly useful where an original eyelet terminal 18 with its own anti-rotation feature (such as tabs extending into the mounting substrate of junction box 10) prevents the use of additional anti-rotation terminals 18 at that location.

Figure 4:
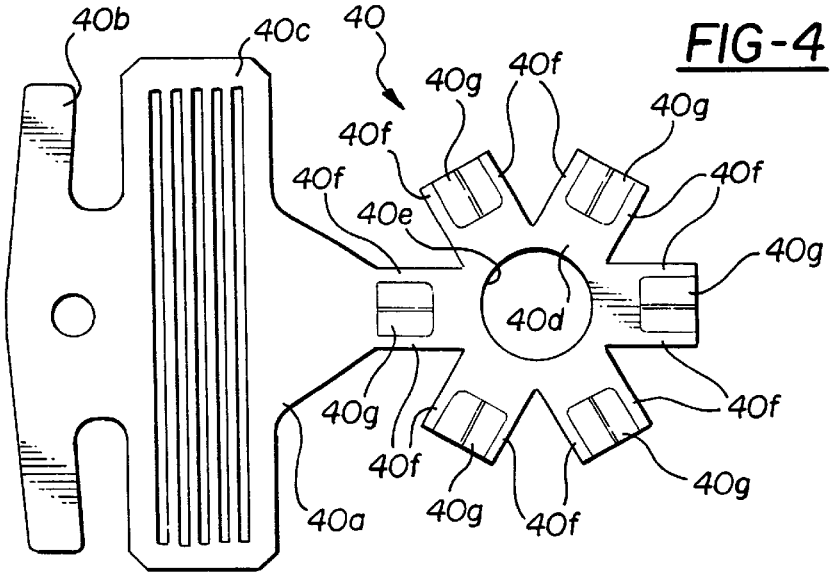
FIG. 4 is a plan view of a preferred terminal blank according to the present invention, for bending into a nut-engaging eyelet.
Figure 5:
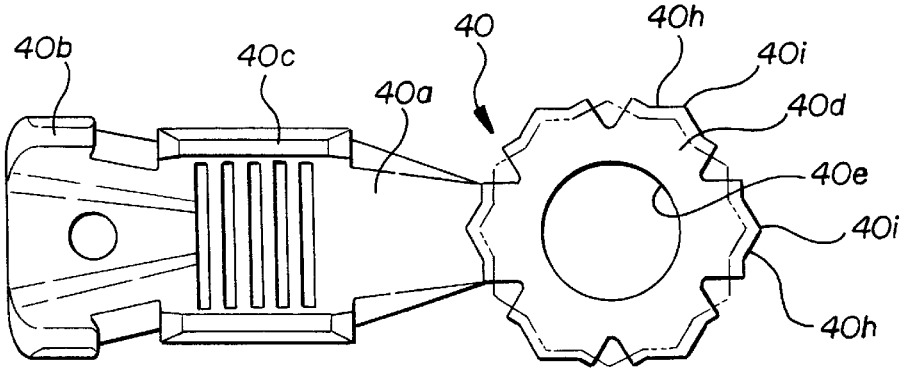
FIG. 5 is a plan view of the terminal blank of FIG. 4, folded, bent, or otherwise formed into a finished eyelet.
Figure 6:
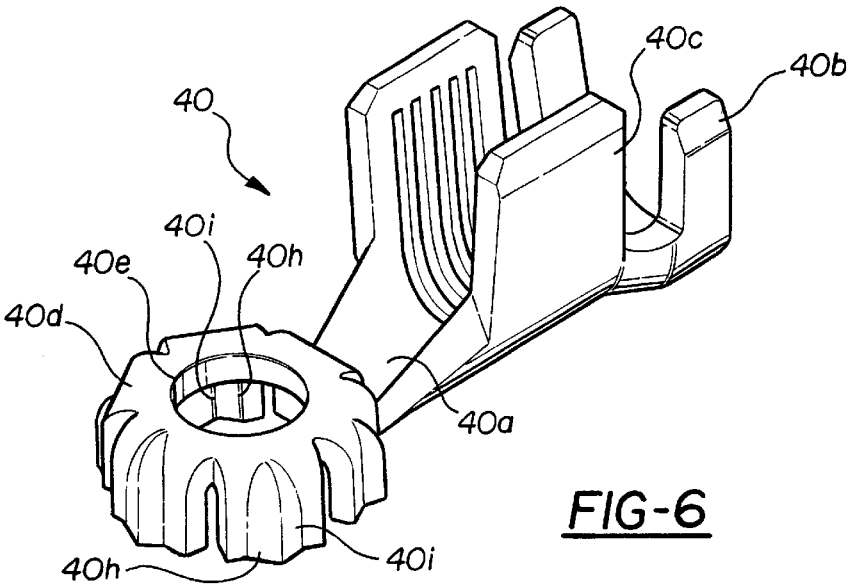
FIG. 6 is a perspective view of the finished terminal of FIG. 5.

While the fully enclosed, solid-sided eyelet cup 30*d* of FIGS. 2–2A and 3–3A may be ideal, from a manufacturing standpoint an alternate eyelet cup as shown in FIGS. 4–6 is preferred as being easier to stamp from a flat blank and subsequently form. Referring first to FIG. 4, terminal 40 is essentially the same as terminal 30 except for the structure of eyelet cup portion 40*d*. Wire connecting stem 40, crimping tabs 40*b*, 40*c* and hole 40*e* are conventional.

Eyelet portion 40*d*, however, is formed with a plurality of crimp arms 40*f* with preformed ends 40*g* either partly stamped, cut, or otherwise pre-stressed so as to form flats and points 40*h*, 40*i* when arms 40 are folded down perpendicular to the plane of the generally flat terminal blank 40, and are then further punched or otherwise formed against appropriate jig structure in a manner known to those skilled in the art. FIG. 5 illustrates the resulting terminal in plan view, with the internal nut-engaging geometry illustrated in broken lines. FIG. 6 illustrates the finished terminal of FIG. 5 in perspective, better showing the more rounded, interrupted nature of the side "wall" of eyelet 40*d* formed by the folded-down crimp arms 40*f*.

It will be understood from the foregoing that the illustrated embodiments of the invention shown and described herein are not intended to limit the scope of the invention, but rather describe two preferred examples from which those skilled in the art will be able to practice the invention in various forms with only minor modifications. The two examples of eyelet 30*d*, 40*d* are but two of many possibilities, depending on the size and shape of the weld nut or terminal nut to which the terminal is intended to be attached in non-rotating manner. The nut-engaging geometry on the interior of the eyelet cup can vary, provided it engages the nut in anti-rotational fashion. It may be possible under some circumstances to apply the invention to nut-type fasteners which are not typical flat-sided polygons, but which are asymmetrically formed so as to provide suitable surfaces which an eyelet cup according to the invention can grip or mate with in anti-rotational fashion once dropped into place over the nut.

I accordingly claim:

1. An eyelet terminal of the type adapted to be secured to an electrical wire or cable at one end and to a nut-using electrical terminal at an eyelet end, the eyelet terminal comprising:

an eyelet in the form of an inverted cup having an internal geometry adapted to be placed over a nut in electrical and mechanical connection therewith such that the eyelet terminal is prevented from rotating relative to the nut, the eyelet further including a hole in an upper surface thereof so as to be aligned with a hole in the nut for admitting a stud or bolt element therethrough to secure the eyelet to the nut in an axial direction.

2. The eyelet terminal of claim 1, wherein the internal geometry of the eyelet is in the form of a multi-sided polygon.

3. The eyelet terminal of claim 1, wherein the eyelet includes a side wall adapted to extend around side surfaces of the nut, the side wall being solid.

4. The eyelet terminal of claim 1, wherein the eyelet includes a side wall adapted to extend around sides of the nut, wherein the side wall is interrupted.

5. The eyelet terminal of claim 4, wherein the eyelet is initially formed as a flat blank comprising a plurality of foldable arms extending radially therefrom.

6. The eyelet terminal of claim 5, wherein the ends of the foldable arms include preformed portions adapted to be bent into flats and points engagable with flats and points on a nut.

7. An eyelet terminal connection comprising:

a weld nut associated with a conductive pathway; and an eyelet terminal secured at one end to an electrical wire or cable, and at the other end having an inverted cup-shaped eyelet with a hole in an upper surface thereof, the eyelet further having an internal geometry adapted to mate with the weld nut so as to prevent rotation of the eyelet relative to the weld nut, the eyelet being placed over the nut with the hole in the eyelet in alignment with the hole in the nut, and further including a threaded fastening element extending through the eyelet into the nut.

8. The terminal connection of claim 7, wherein the threaded fastening element is a bolt.

9. The terminal connection of claim 7, wherein the threaded fastening element is a threaded stud, and further including a second nut threaded over the stud.

10. An eyelet terminal connection comprising:

a previously-established terminal connection comprising a first eyelet terminal secured over a stud and locked thereto with a nut threaded over the stud onto an upper surface of the eyelet, and a second nut-engaging eyelet comprising an inverted cup-shaped eyelet having an internal geometry adapted to be placed over the nut and to mate therewith in non-rotating fashion, and further having a hole in an upper surface thereof to permit passage of the stud, and further including a second nut threaded over the stud onto the upper surface of the second eyelet.

* * * * *

UNITED STATES PATENT AND TRADEMARK OFFICE

CERTIFICATE OF CORRECTION

PATENT NO. : 6,250,975 B1
DATED : June 26, 2001
INVENTOR(S) : LaPointe

It is certified that error appears in the above-identified patent and that said Letters Patent is hereby corrected as shown below:

Title page,
Designation of Assignee, delete the period (".") after EWD;

Column 3,
Line 60, delete "20" after the word "than".

Signed and Sealed this

Fifth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,250,975 B1
DATED : June 26, 2001
INVENTOR(S) : LaPointe

It is certified that error appears in the above-identified patent and that said Letters Patent is hereby corrected as shown below:

Title page,
Designation of Assignee, delete the period (".") after "EWD".

Column 3,
Line 60, delete "20" after the word "than".

This certificate supersedes Certificate of Correction issued Feb. 5, 2002

Signed and Sealed this

Tenth Day of December, 2002

JAMES E. ROGAN
*Director of the United States Patent and Trademark Office*